US008083086B2

(12) United States Patent
Alvares

(10) Patent No.: US 8,083,086 B2
(45) Date of Patent: Dec. 27, 2011

(54) CLOSURE ARRANGEMENT FOR CONTAINERS

(75) Inventor: Antonio Carlos Teixeira Alvares, Sao Paulo (BR)

(73) Assignee: Brasilata S/A Embalagens Metalicas, Sao Paulo-SP (BR)

( * ) Notice: Subject to any disclaimer, the term of this patent is extended or adjusted under 35 U.S.C. 154(b) by 639 days.

(21) Appl. No.: 12/282,050

(22) PCT Filed: Mar. 7, 2007

(86) PCT No.: PCT/BR2007/000057

§ 371 (c)(1),
(2), (4) Date: Nov. 12, 2008

(87) PCT Pub. No.: WO2007/104118

PCT Pub. Date: Sep. 20, 2007

(65) Prior Publication Data

US 2009/0057313 A1 Mar. 5, 2009

(30) Foreign Application Priority Data

Mar. 10, 2006 (BR) ..... 0600882

(51) Int. Cl.
*B65D 17/40* (2006.01)

(52) U.S. Cl. ..... 220/254.1; 220/256.1; 220/270; 220/276; 220/796; 215/250

(58) Field of Classification Search ..... 220/254.1, 220/256.1, 270, 276, 796; 215/250
See application file for complete search history.

(56) References Cited

U.S. PATENT DOCUMENTS 5,899,352 A 5/1999 Guarda et al.

FOREIGN PATENT DOCUMENTS

| | | |
|---|---|---|
| DE | 895998 | 11/1953 |
| EP | 0134448 | 3/1985 |
| EP | 1561696 A1 | 8/2005 |
| WO | WO-03074381 A1 | 9/2003 |

*Primary Examiner* — Anthony Stashick
*Assistant Examiner* — Elizabeth Volz
(74) *Attorney, Agent, or Firm* — Fish & Richardson P.C.

(57) ABSTRACT

A closure arrangement for containers of the type comprising an annular upper wall (13) having an outer edge (13*a*) hermetically affixed to a lateral wall (11) of the container, and an inner edge (13*b*) defining an upper opening (14) to be closed by a lid (20), which comprises a peripheral wall (22) externally provided with a first and a second circumferential groove (23, 24) and an annular flange (25), incorporating a pending circumferential projection (26), said lid (20) being mounted in a first closing position, in which the inner edge (13*b*) is fitted in the first circumferential groove (23) defining a first sealing region and the pending circumferential projection (26) is fitted in the circumferential recess (16) defining therein a second sealing region, said lid (20) being mounted in a second closing position, after the first opening, in which the inner edge (13*b*) is fitted in the second circumferential groove (24), retaining the latter and defining therein a third sealing region.

17 Claims, 4 Drawing Sheets

CLOSURE ARRANGEMENT FOR CONTAINERS

FIELD OF THE INVENTION

The present invention refers to a closure arrangement to be applied to containers in general, particularly to a can made of sheet metal or to another similar container, of the type comprising a tubular body with the lower end thereof affixing or incorporating a bottom wall and with the upper edge thereof carrying, directly by means of a deformed portion of the tubular body or by means of an upper annular wall portion that can take the form of a structural ring, a seat for the seating and retention of a press-fit lid generally formed in plastic material. The closure arrangement of the invention is particularly suitable for containers designed to contain progressive consumption products, which demand a high degree of tightness of the container for long shelf lives.

BACKGROUND OF THE INVENTION

Determined products, such as certain food products, have to be submitted to a hermetic storage for long periods of shelf life until the first opening and provided with a clear visual indication to the consumer that the package in which they are presented to the market has not been violated. Considering that many of these products are of progressive consumption, it is indispensable that, upon the first opening of the package, the lid which gives access to the interior of the can be closed again as many times as necessary during the progressive consumption of the stored product, in order to guarantee the tightness of the re-closed can and protect the remainder of the content thereof.

There are well known in the art the cans provided with a press-fit lid, which is fitted, by pressure, in a peripheral structural ring, internal to the upper edge of the body of the can and defining an annular upper wall for the latter. The tightness of the content is guaranteed, in this type of construction, by the lid fitting in the seating and retention seat, which can be provided in the structural ring that defines the annular upper wall of the can or in the tubular body of the latter.

In this type of closure it is desirable to obtain a high degree of tightness for long periods of shelf life, until the first opening of the container, and also thereafter, upon the subsequent closings of the lid during the progressive consumption of the packaged product. Moreover, it is also necessary that the opening and closing operations of the container are easy and safe, preventing injuries in the fingers of the user and also an involuntary and uncontrolled release of the product due to a sudden removal of the lid.

The Brazilian patent PI 0203950-8 of the same applicant proposes a closure arrangement for containers of the type considered herein, using a plastic lid comprising a sealing portion to be removably seated in the seat of the container and provided with an upper edge projecting radially to the outside of the seat, to be incorporated, by means of breakable bridges, to a seal portion carrying a lower skirt which is seated around the upper end of the container and which presents an interruption in which is positioned a gripping tab projecting downwardly from the sealing portion to which it is radially incorporated. The gripping tab can only be operated upwardly for removing the lid after breaking part of the seal portion and the breakable bridges, said seal portion being configured to cover the gripping handle. This prior construction of the same applicant is particularly directed to the tamper evident seal, the tightness of the lid being object of a constructive arrangement described and claimed in the Brazilian patent 9408643-5

(U.S. Pat. No. 5,899,352 and EP 0 706 486) and also in the Brazilian patent application PI 0203950-8 (PCT/BR03/00030), of the same applicant, according to which a circumferential groove, externally provided on a lateral peripheral wall of the lid and having a cross section in the form of an arc of a circle or a concave arc, is seated onto a circumferential rib, having a cross section in the form of an arc of a circle or a convex arc, formed in the annular upper wall of the container and defining the upper opening of the latter. The circumferential groove of the lid and the circumferential rib of the annular upper wall are configured to provide not only a safe axial retention of the lid on the container, but also a high degree of tightness of the closure.

However, the degree of tightness provided by this closure arrangement of the prior art does not guarantee the tightness required for storing certain products, as is the case of certain food products that require long shelf lives, without contamination of the interior of the container through penetration of contaminants or reduced amounts of oxygen from the ambient air.

This prior art closure arrangement allows easy and safe operations of opening and closing the lid, without the need of auxiliary tools, providing a reliable tamper evidence by the seal portion and also an adequate degree of tightness for the packaging of several products during the shelf lives thereof and, particularly, upon the closing of the lid after the first opening, during the progressive consumption of the packaged product.

However, despite all the positive features mentioned above, said closure arrangement object of PI 0203950-8 allows further improvements directed to a higher degree of tightness during the period of shelf storage, without impairing or harming the reopening and closing operations of the lid.

SUMMARY OF THE INVENTION

As a function of the deficiencies of the prior art closure arrangements, it is an object of the present invention to provide a closure arrangement for containers of the type defined above and having a high degree of tightness, sufficient for guaranteeing the integrity of the packaged product not only during the required periods of shelf life, applicable to perishable products, as is the case of food products, but also during the periods defined between the operations of opening and closing of the container after its first opening and during the progressive consumption of the packaged product.

It is a further object of the present invention to provide a closure arrangement such as defined above, which allows the opening and closing operations to be easily carried out by the user, in a safe and controlled manner, without risks of injuries and abrupt release of the packaged product.

It is still a further object of the invention to provide a closure arrangement as defined above and presenting a tamper evident seal, which must be broken to allow the first opening of the lid.

These and other objects and advantages of the present invention are provided by a closure arrangement for containers of the type comprising at least one lateral wall ending in an upper edge of the container and an annular upper wall having and outer edge hermetically fixed to the lateral wall and an inner edge defining an upper opening to be closed by a lid.

According to the invention, the lid comprises a middle wall carrying a peripheral wall externally provided with a first and a second circumferential groove and externally incorporating an annular flange in which is inferiorly incorporated at least one pending circumferential projection, the annular upper wall being provided with at least one circumferential recess.

With this construction, the lid is mounted in a first closing position after the filling of the product and in which the inner edge of the annular upper wall is fitted into the first circumferential groove of the lid, axially retaining the latter and defining therein a first sealing region and in which the pending circumferential projection of the lid is fitted, by interference, into the circumferential recess of the annular upper wall, defining therein a second sealing region, said lid being mounted in a second closing position, after the first opening, in which the inner edge of the annular upper wall is fitted in the second circumferential groove of the lid, axially retaining the latter and defining therein a third sealing region in which the pending circumferential projection is held elevated and unfitted in relation to the circumferential recess of the annular upper wall.

The closure arrangement proposed herein allows that, after being filled with the product, the container is sealed by the lid still provided with the seal portion and which is taken to the first closing position in which are defined the first and the second sealing regions, with the axial retention of the lid in the closed position occurring in the first sealing region. The provision of the second sealing region substantially increases the degree of tightness of the container, guaranteeing long periods of storage or shelf life, until the first opening of the lid takes place after the breaking and removal of the seal portion.

After the first opening, the container may be reclosed multiple times, with the lid being taken to the second closing position, in which the axial retention thereof takes place in the third sealing region, which functions in the same manner as the first sealing region. However, in the second closing position, the second sealing region is not used, making easier successive opening and closing operations of the container by the lid during the progressive consumption of the product, when the use of the third sealing region is sufficient to provide the desired tightness.

BRIEF DESCRIPTION OF THE DRAWINGS

The invention will be described below with reference being made to the attached drawings, given by way of example of one construction of the closure arrangement and in which.

DETAILED DESCRIPTION OF THE INVENTION

Figure 1:
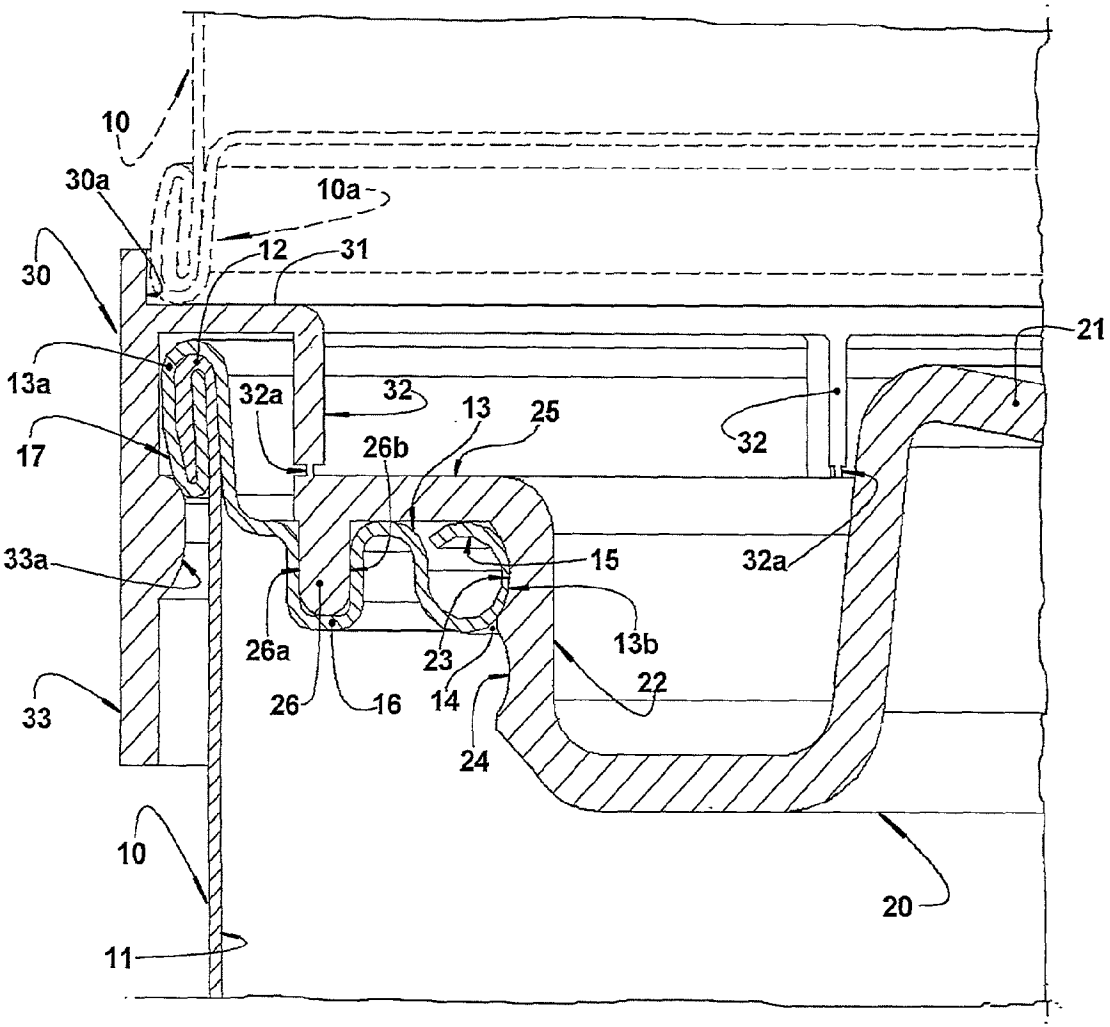
FIG. 1 is a diametral cross sectional view of a lid seated on the upper edge of a container in the form of a can, in a first closing position, according to the subject closure arrangement.

The present arrangement is generally applied to a container 10 of tubular shape, inferiorly closed by a bottom wall 10*a* shown in dotted lines in FIG. 1 and comprising at least one lateral wall 11 ending in an upper edge 12, and an annular upper wall 13 having an outer edge 13*a* hermetically joined to the lateral wall 1 and an inner edge 13*b* defining an upper opening 14 for the container 10, to be closed by a lid 20 usually built in a single piece of plastic material.

It should be understood that the container 10 may be built in different manners and of different materials, with the bottom wall (not illustrated) being incorporated in a single piece, by double seaming or any other method, to the lateral wall. The annular upper wall 13 may take the form of a structural ring, of sheet metal, which is double seamed to the upper edge 12 of the lateral wall 11 or obtained in a single piece with the lateral wall 11, by radial deformation of the latter, when built of sheet metal.

According to a first aspect of the present closure arrangement, the annular upper wall 13 has its inner edge 13*b* configured with a cross section in the form of a convex arc, preferably an arc of a circle, the container 10 being built of sheet metal, the inner edge 13*b* of the annular upper wall 13 being defined by an inner end portion of the latter, curved upwardly and outwardly, to take the form of a tubular rib 15 that, in the illustrated embodiment, has a circular or substantially circular cross section. It should be understood that the inner edge 13*b* of the annular upper wall 13 is not necessarily built as a tubular rib, being sufficient to present a convex arc cross section. However, for reasons of operational safety and for protection of the product to be filled, it is desirable that the convex arc cross section is obtained by bending the inner edge 13*b* upwardly and outwardly until it reaches the annular upper wall 13. The annular upper wall 13 is further provided, in the middle portion thereof, with at least one circumferential recess 16, turned upwards and which may present a "U" shaped cross section, which configures internal 16*a* and external 16*b* circumferential faces, and whose function will be described below.

In the illustrated embodiment, in which the container 10 is formed in sheet metal, with the annular upper wall 13 affixed to the upper edge 12 of the lateral wall 11 by double seaming, the latter defines a projecting radial rib 17, externally incorporated to the upper edge 12 of the lateral wall 11 and defining an annular step lower in relation to said lateral wall 11. In this construction, the circumferential recess 16 is defined by a respective curved or deformed portion of the annular upper wall 13.

In the container constructions in which the annular upper wall 13 is not double seamed in the lateral wall 11, the latter has its upper edge 12 shaped to define, by curling or by thickening, said projecting radial rib 17.

As mentioned above, the closure arrangement further comprises the lid 20, preferably made in a single piece of plastic material and comprising a middle wall 21 of circular contour and carrying a peripheral wall 22, normally projecting axially upwardly from the middle wall 21 and being externally provided with a first and a second circumferential groove 23, 24. The peripheral wall 22 superiorly and externally incorporates an annular flange 25 projecting radially outwards and in which is inferiorly incorporated at least one pending circumferential projection 26.

In the illustrated embodiment is provided only one pending circumferential projection 26, of generally rectangular cross section and defining an external circumferential face 26*a* and an internal circumferential face 26*b*.

Still according to the illustrated embodiment, the first and second circumferential grooves 23, 24 of the lid 20 have the same cross section in the form of a concave arc, preferably an arc of a circle.

With the construction of container 10 and lid 20 described above, the lid 20 may be mounted in a first closing position, after the product has been filled inside the container 10, in which said first closing position the inner edge 13*b* of the annular upper wall 13 is fitted into the first circumferential groove 23 of the lid 20, allowing the latter to be axially retained to the container and defining a first sealing region between the first circumferential groove 23 of the lid 20 and the inner edge 13*b* of the annular upper wall 13. It should be understood that the cross section of the inner edge 13*b* of the annular upper wall 13 and of the first circumferential groove 23 is dimensioned to allow a mutual seating between said parts in at least part of the transverse extension of the first circumferential groove 23, making this seating not only axially lock the lid 20 to the container, but also defining a first sealing region sufficient to provide a determined degree of tightness to the closure of the container 10.

As illustrated in FIG. 1, when the lid 20 is in the first closing position after the filling of the product and before the first opening of the container 10, the pending circumferential projection 26 of the lid 20 is fitted, by interference, in the circumferential recess 16 of the annular upper wall 13, defining therein a second sealing region that, together with the first sealing region, guarantee a high degree of tightness to the closure of the container 10, allowing the storage thereof for long periods.

Figure 2:
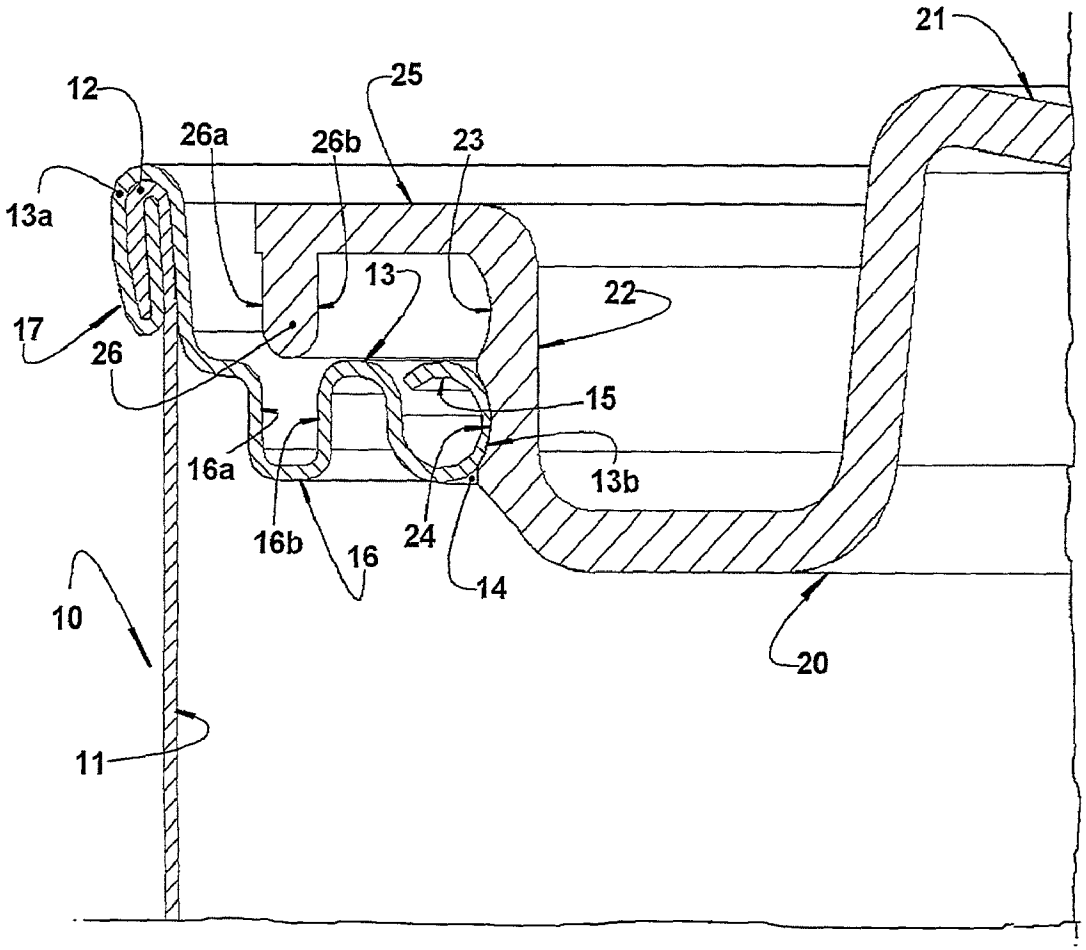
FIG. 2 is a diametral cross sectional view of a lid seated on the upper end of a container in the form of a can, in a second closing position, according to the subject closure arrangement.

After the lid has been subjected to a first opening operation, so that the progressive consumption of the packaged product may start, the lid 20 may be closed again in a second closing position, in which the inner edge 13*b* of the annular upper wall 13 is fitted and seated in the second circumferential groove 24 of the lid 20, axially retaining the latter and defining, inside said second circumferential groove 24, a third sealing region, wherein in this second closing position the pending circumferential projection 26 is kept elevated and unfitted in relation to the circumferential recess 16 of the annular upper wall 13, as illustrated in FIG. 2.

As it may be observed, the first and the second circumferential groove 23, 24 have the same cross section, configured in a concave arc, preferably in an arc of a circle, in order to seat, in at least part of its transverse extension the inner edge 13*b* of the annular upper wall 13. The seating of the inner edge 13*b* of the annular upper wall 13 in the first and the second circumferential groove 23, 24 provide a degree of tightness to the closure of the container which is normally sufficient and suitable to the preservation of the packaged product during the period in which the progressive consumption thereof takes place, when are necessary successive operations of opening and closing the container by the lid in the second closing position. The fact that the second closing position provides only the fitting by interference between the inner edge 13*b* of the annular upper wall 13 and the second circumferential groove 24, allows the lid to be more easily removed from the container, since in this second closing position the fitting by interference between the pending circumferential projection 26 and the circumferential recess 16 of the annular upper wall 13 is not effected.

As mentioned above, the pending circumferential projection 26 of the lid 20 has a rectangular cross section dimensioned so that the external 26*a* and internal 26*b* circumferential faces of said pending circumferential projection 26 are seated, by interference, against the respective external and internal circumferential faces 16*a*, 16*b*, respectively, of the circumferential recess 16 when the lid 20 is carried to the first closing position, said interference seatings defining said second sealing region. The axial extension of the pending circumferential projection 26 is designed to prevent the lower end portion thereof from interfering with the bottom of the circumferential recess 16 when the lid is mounted in said first closing position illustrated in FIG. 1.

As mentioned in the introduction of the present disclosure, when packaging certain perishable or oxidizable products, it is highly desirable that the closure arrangement of the container 10 is provided with a tamper evident seal that provides the consumer with a reliable indication that the product being purchased has not been violated.

In order to fulfill the above mentioned need, the lid 20 may be built comprising a seal portion 30, defined by an upper ring 31 located over the upper edge 12 of the lateral wall 11 and internally incorporating a plurality of axial bridges 32, each having a weakened lower end 32*a* joined to the annular flange 25 and dimensioned to be broken upon the removal of the seal portion 30, as described further below. The upper ring 31 of the seal portion 30 externally incorporates a lower skirt 33 to be seated and axially retained around said upper edge 12 of the lateral wall 11, the seal portion 30 having an interruption 34 in the circumferential extension thereof.

In the construction illustrated in FIG. 1, the annular flange 25 of the lid 20 is provided in a plane lower than the one containing the upper ring 31 of the seal portion 30, the axial bridges 32 being located between said parts, in a vertical or inclined arrangement. In case the annular flange 25 and the upper ring 31 are coplanar, the axial bridges 32 may be arranged in a substantially horizontal manner.

The lid 20 further comprises a gripping tab 27 projecting axially upwards and radially outwards from the annular flange 25 and axially down, over the upper edge 12 of the lateral wall 11, through said interruption 34 of the seal portion 30.

It is further provided a seal bridge 35 having opposite ends incorporated in a single piece to the lower skirt 33 and extending over the interruption 34 of the seal portion 30 and over the gripping tab 27 in the region of the latter that projects axially downwards, one of the ends of the seal bridge 35 being incorporated to the lower skirt 33 by connecting means 36, to be broken when said end of the seal bridge 35 is forced away from the lower skirt 33, so as to provide manual access to the gripping tab 27.

The arrangement mentioned above allows that the lid 20 is only removed from the container 10 upon the rupture of the seal portion 30 or, more specifically, the weakened lower end 32*a* of the axial bridges 32. To occur this, it is necessary that the user breaks the seal bridge 35 and then all the axial bridges 32, separating the seal portion 30 from the remaining of the lid 20 and exposing the gripping tab 27 pending over the upper edge 12 of lateral wall 11 of the container 10, so that the user can lift the gripping tab 27 using one or more fingers of his hand, pulling the lid out of its first closing position.

According to the illustrated embodiment, the gripping tab 27 is substantially leveled with the upper ring 31 and the lower skirt 33, maintaining with said parts a gap 29 throughout its extension, the gripping tab being also at least partially hollow in the preferred embodiment, in order to define a kind of handle.

In order to axially retain the seal portion 30 to the container 10, the lower skirt 33 of the former incorporates at least one internal radial projection 33*a*, which may take the form of a circumferential rib and is located under the projecting radial rib 17 of the upper edge 12 of the lateral wall 11 of the container 10, axially locking the seal portion 30 to the container 10 when the lid 20 is in the first closing position illustrated in FIG. 1.

Figure 3:
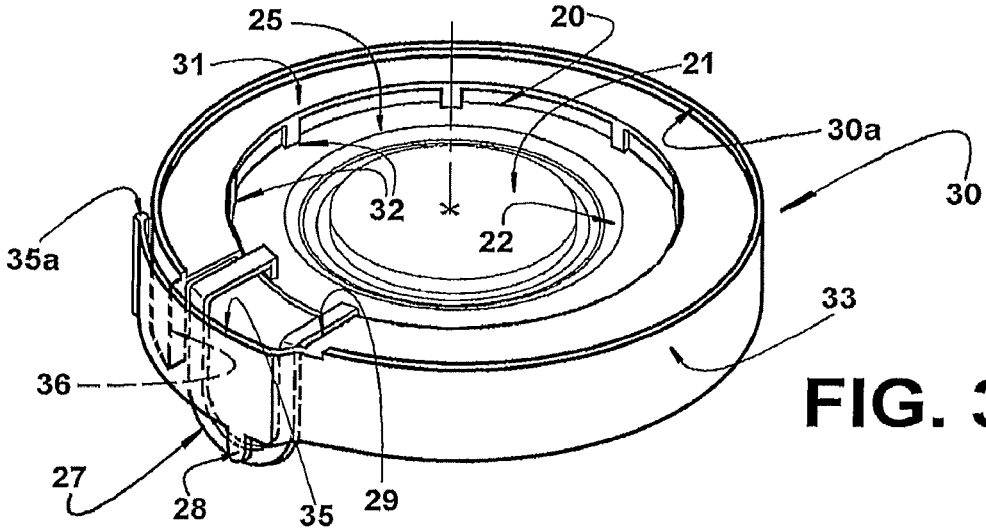
FIG. 3 is an upper perspective view of the plastic lid of the present invention, incorporating a seal portion.
Figure 4:
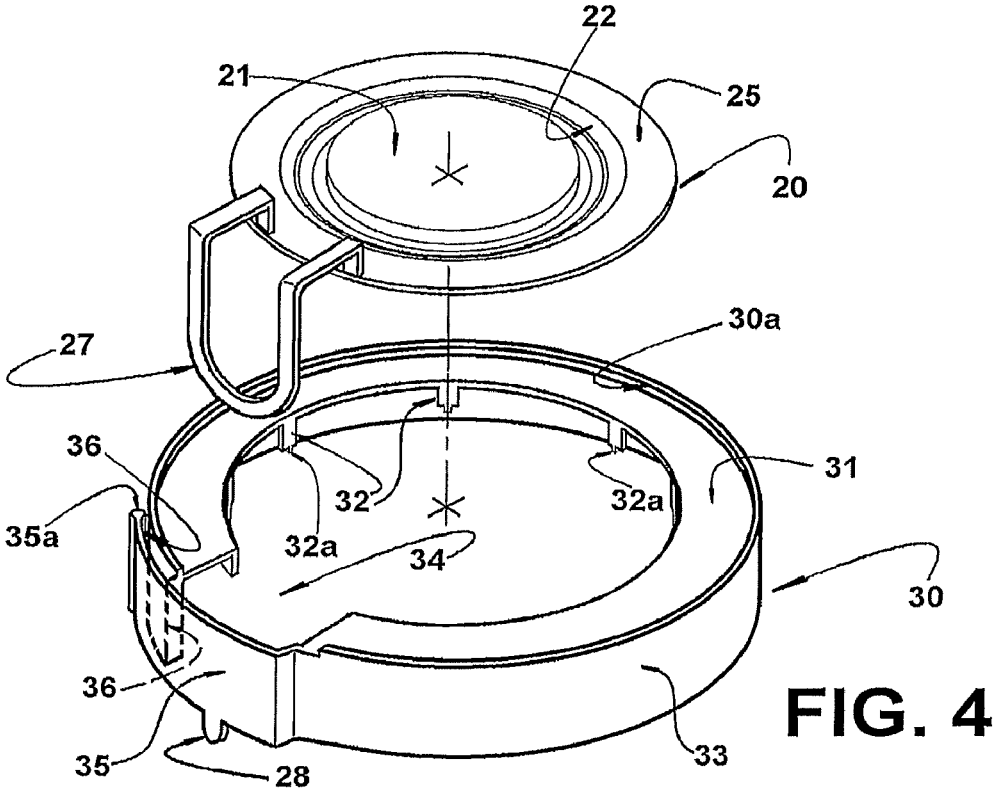
FIG. 4 is an exploded perspective view of the lid of FIG. 3, after the breaking of the seal portion.
Figure 5:
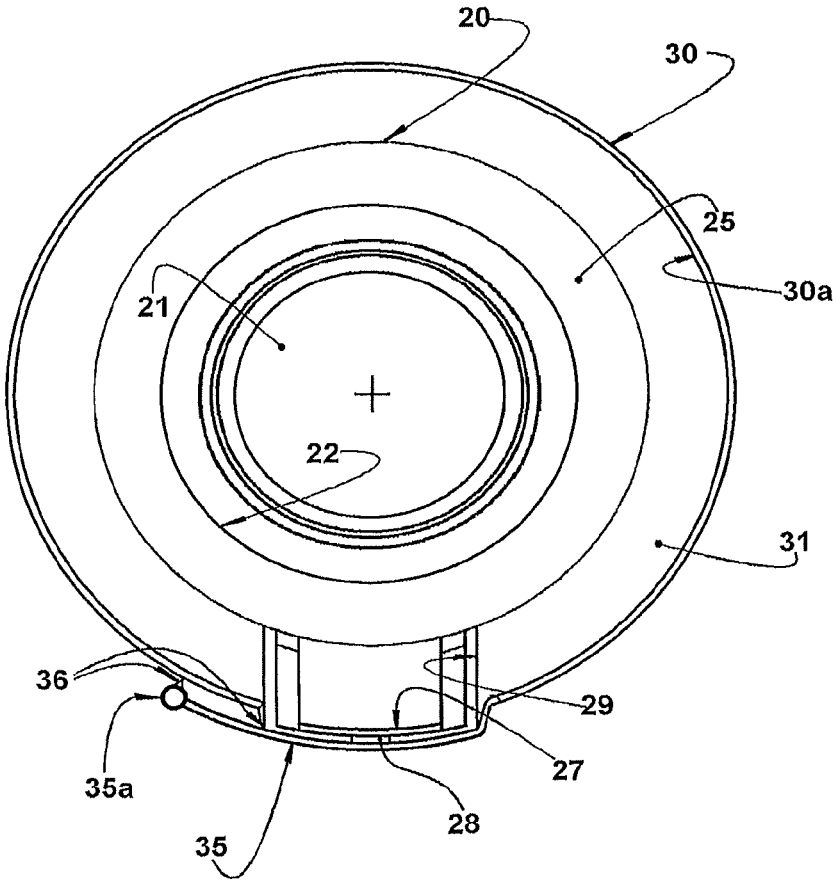
FIG. 5 is an upper plan view of the plastic lid of FIG. 3.

In the lid construction illustrated in FIGS. 3, 4 and 5, the seal bridge 35 has a first end 35*a* incorporated to the lower skirt 33 by connecting means 36, which are broken when said first end 35*a* is forced away from the lower skirt 33, for example by being radially pulled outwardly, in order to allow the manual access to the gripping tab 27. In this embodiment, the seal bridge 35 has the first end 35*a* thereof placed over the lower skirt 33, being incorporated thereto by two connecting means 36 circumferentially spaced from each other. It is also preferable that the gripping tab 27 is inferiorly incorporated to the seal bridge 35 by means of a breakable lock 28 in the form of one or more axial bridges, which are manually broken upon the first opening of the lid 20 by action of the user on the gripping tab 27.

As mentioned before, the gripping tab 27 allows an easy removal of the lid 20 from its seat on the container 10 and also a controlled and progressive opening of the container, first in the region adjacent to the gripping tab 27 and then in the remaining of the opening 14 of the container, avoiding that the packaged product is abruptly and inadvertently pulled out of the container.

In order to avoid lateral displacements between two vertically stacked containers, the seal portion 30 may be built so that the upper ring 31 incorporates a circumferential projection 30*a*, continuous or defined in segments, projecting upwardly from the upper edge 12 of the lateral wall 11 of the container 10, in order to fit loosely and telescopically and, depending on its radial dimension, on the outside or on the inside of the lower end 10*a* of another container 10 immediately seated on the previous one.

Although only one mode of carrying out the invention has been described and illustrated herein, it should be understood that modifications in the form and arrangement of the component parts the closure arrangement may be effected, without departing from the inventive concept defined in the accompanying claims.

The invention claimed is:

1. Closure arrangement for containers of the type comprising at least one lateral wall (11) ending in an upper edge (12) and an annular upper wall (13) having an outer edge (13*a*) hermetically affixed to the lateral wall (11) and an inner edge (13*b*) defining an upper opening (14) to be closed by a lid (20), characterized in that the lid (20) comprises a middle wall (21) carrying a peripheral wall (22) externally provided with a first and second circumferential groove (23, 24) and externally incorporating an annular flange (25), in which is inferiorly incorporated at least one pending circumferential projection (26), the annular upper wall (13) being provided with at least one circumferential recess (16), said lid (20) being assembled in a first closing position, after the filling of the product, in which the inner edge (13*b*) of the annular upper wall (13) is fitted in the first circumferential groove (23) of the lid (20), axially retaining the latter and defining therein a first sealing region and in which the pending circumferential projection (26) of the lid (20) is fitted, by interference, in the circumferential recess (16) of the annular upper wall (13), defining therein a second sealing region, said lid (20) being mounted in a second closing position, after a first opening, in which the inner edge (13*b*) of the annular upper wall (13) is fitted in the second circumferential groove (24) of the lid (20), axially retaining the latter and defining therein a third sealing region in which the pending circumferential projection (26) is held elevated and unfitted in relation to the circumferential recess (16) of the annular upper wall (13).

2. Arrangement, according to claim 1, characterized in that the first and second circumferential groove (23, 24) of the lid (20) have a cross section in the form of a concave arc, the inner edge (13*b*) of the annular upper wall (13) having a cross section in the form of a convex arc and configured to be seated against at least part of the transverse extension of the first and second circumferential groove (23, 24), said seats defining, respectively, the first and third sealing regions.

3. Arrangement, according to claim 2, characterized in that the cross section of the first and second circumferential groove (23, 24) and the inner edge (13*b*) of the annular upper wall (13) are defined by arcs of circles.

4. Arrangement, according to claim 2 and having the lateral wall (11) and the annular upper wall (13) formed in sheet metal, characterized in that the circumferential recess (16) and the inner edge (13*b*) of the annular upper wall (13) are defined by respective curved portions of the latter.

5. Arrangement, according to claim 4, characterized in that the inner edge (13*b*) of the annular upper wall (13) is curved upwardly and outwardly, in order to take the form of a tubular rib (15).

6. Arrangement, according to claim 5, characterized in that the tubular rib (15) has a substantially circular cross section.

7. Arrangement, according to claim 4, characterized in that the circumferential recess (16) of the annular upper wall (13) has a U-shaped cross section and external circumferential face (16*a*) and internal circumferential face (16*b*), the pending circumferential rib (26) of the lid (20) having a rectangular cross section defining an external circumferential face (26*a*) and an internal circumferential face (26*b*), which are seated, by interference, respectively against the external and internal circumferential faces (16*a*, 16*b*) of the circumferential recess (16) when the lid (20) is taken to the first closing position, said interference seats defining the second sealing region.

8. Arrangement, according to claim 1, characterized in that the lid (20) is formed in a single piece of plastic material.

9. Arrangement, according to claim 8, characterized in that the lid (20) further comprises: a seal portion (30) defined by an upper ring (31), located over the upper edge (12) of the lateral wall (11) and internally joined to the annular flange (25) by a plurality of breakable axial bridges (32) externally incorporating a lower skirt (33) to be seated and axially retained around said upper edge (12) of the lateral wall (11), said seal portion (30) having an interruption (34) in its circumferential extension; a gripping tab (27) projecting radially to the outside of the annular flange (25) and axially downwardly, over the upper edge (12) of the lateral wall (11), through said interruption (34) of the seal portion (30); and a seal bridge (35) having opposite ends incorporated, in a single piece, to the lower skirt (33) and extending over the interruption (34) of the seal portion (30) and over the gripping tab (27), one of the ends of the seal bridge (35) being incorporated to the lower skirt (33) by connecting means (36) that are broken when said end is forced away from the lower skirt (33), in order to allow the manual access to the gripping tab (27).

10. Arrangement, according to claim 9, characterized in that each axial bridge (32) has a weakened lower end (32*a*) joined to the annular flange (25) and dimensioned to be broken upon the removal of the seal portion (30).

11. Arrangement, according to claim 9, characterized in that the gripping tab (27) is substantially leveled with both the upper ring (31) and the lower skirt (33), maintaining with said parts a gap (29) throughout its extension.

12. Arrangement, according to claim 9, characterized in that at least part of the gripping tab (27) is at least partially hollow, in order to define a handle.

13. Arrangement, according to claim 9, characterized in that the gripping tab (27) is axially and inferiorly extended beyond the lower skirt (33) of the seal portion (30).

14. Arrangement, according to claim 9 and having the lateral wall (11) and annular upper wall (13) formed in sheet metal and the upper edge (12) of the lateral wall (11) incorporating a projecting radial rib (17), characterized in that the lower skirt (33) incorporates at least one inner radial projection (33*a*) to be housed under the projecting radial rib (17) axially locking the seal portion (30) to the container when the lid (20) is in the first closing position.

15. Arrangement, according to claim 14, characterized in that the projecting radial rib (17) is defined by the double seaming of the annular upper wall (13) in the lateral wall (11).

16. Arrangement, according to claim 9, characterized in that the upper ring (31) incorporates a circumferential rib (30*a*) projecting upwardly from the upper edge (12) of the lateral wall (11) of the container (10), in order to loosely and telescopically fit in the lower end (10*a*) of another container (10) stacked on the previous one.

17. Arrangement, according to claim 16, characterized in that the circumferential rib (30*a*) is continuous.

* * * * *